United States Patent [19]

Hinton

[11] 4,146,935

[45] Apr. 3, 1979

[54] GLOVE FOR HOBBLING GRIP

[76] Inventor: Eddie Boyd Hinton, 1441 Glen Aulen St., Modesto, Calif. 95350

[21] Appl. No.: 837,604

[22] Filed: Sep. 28, 1977

[51] Int. Cl.[2] ..... A41D 19/00

[52] U.S. Cl. ..... 2/161 A

[58] Field of Search ..... 2/161 A, 159, 167, 163; 272/67, 68

[56] References Cited

U.S. PATENT DOCUMENTS

| | | | |
|---|---|---|---|
| 2,447,951 | 8/1948 | Lindfelt | 2/167 |
| 3,882,548 | 5/1975 | Shinagawa et al. | 2/161 A |
| 3,918,096 | 11/1975 | Lim | 2/161 A |

FOREIGN PATENT DOCUMENTS

| | | | |
|---|---|---|---|
| 1077731 | 5/1954 | France | 2/159 |

*Primary Examiner*—Dorsey Newton

*Attorney, Agent, or Firm*—J. L. Bohan

[57] ABSTRACT

A sports glove for use particularly in golf wherein the glove is to be worn on the dominant hand so as to reduce its gripping power whereby the non-dominant hand and arm can control the golf swing.

7 Claims, 4 Drawing Figures

GLOVE FOR HOBBLING GRIP

BACKGROUND OF THE INVENTION

This invention relates to a glove which will reduce the gripping power of the dominant hand of an individual so that in playing a game, such as, golf, the non-dominant hand and arm can dominate and control the golf swing.

Conventional gloves made of fabric or leather material used by golfers for the purpose of improving the grip or increasing the power of the swing. The glove of the present invention has as its express purpose the reduction of the power applied during the swing from the dominate side of the body which is normally the right side.

A glove useful for golf games which is of the type for providing increased power to wrist action of the wearer is disclosed in U.S. Pat. No. 3,261,026 issued on July 19, 1966, to Blanchard W. Joseph. This glove provides an elastic band located along the side of the hand and going to the wrist which is taut when the hand and wrist are bent in one direction on the upswing, but adds force and power to the normal wrist action on the downswing.

Another glove shown in prior art is that disclosed in U.S. Pat. No. 3,918,096, issued on Nov. 11, 1975, to Eui Joon Lim. This glove is designed particularly for use in driving motorcycles where the hand is maintained in a curved position over long periods of time. In order to avoid fatigue, a backing material is provided which extends along the back of the hand and the fourfinger portions. This glove is designed so that when the hand is inserted into the glove it imparts thereto a convex curvature at the palm, thereby in effect pre-cupping the hand so as to minimize the amount of force required to hold on to the handle grips of the motorcycle.

SUMMARY OF THE INVENTION

One of the reasons the game of golf is extremely difficult to master is due to a paradox with regard to the distribution of control and power between the right and left side of the body of the player. In a right-handed player, for example, it is normal to grip the club so that the right hand is lower on the club and thereby closest to the striking face of the club. It is apparently instinctive to grasp a club in this manner when one is right-handed since the right hand is most accurately controlled by the brain it is in a position to make fine adjustments during the course of the swing so as to maximize the control of the aim. However, the paradox in golf is that the natural instincts are to also apply considerable power with the right hand at the instant of striking the ball so as to drive the ball as far as possible. However, it is well known in golf that in a right-handed person the left side of the body is the side which must dominate or control the golf swing. This side of the body is frequently referred to as the "hitting side" and is the side that would be closest to the intended flight of the ball. One of the most difficult things to teach a new golfer is that the arm and hand of the hitting side must control the golf swing if the ball is to be hit properly. In most cases the golfer is right-handed and the left arm and hand are weaker and, as a result, the right hand invariably attempts to take over the swing. When this happens the ball is hit improperly causing hooking, slicing, topping or other problems. Considerable practice and concentration is required to teach a new golfer to build up the power and control in the left side and diminishing the power and control on the right side. Only after this has been accomplished is a golfer on the way to becoming a fairly proficient practitioner of the sport. Unfortunately, most players play with such a degree of zeal that they continue to allow the right hand to dominate the swing thereby continuing poor control and poor hitting performance.

The sporting glove of the present invention has as its purpose the reduction of the grip in the dominant hand so that it is substantially equal to or slightly less than the grip of the non-dominant hand. For the sake of simplicity in describing the invention, the dominant hand will be referred to as the right hand, and the non-dominant hand will be referred to as the left hand since the majority of the population is right-handed. However, it is to be understood that when the term right hand is used in this specification, it is intended to include the left hand when the individual involved is left-handed.

Accordingly, by providing the golf player with a glove of the present invention, his right hand is unable to apply a full normal grip. This is accomplished by placing along the back side of the hand portion of the glove and the finger portions of the glove, including the thumb, an elastic material. Accordingly, when the hand is in a normal, open position, the elastic material is in a non-stressed condition. However, once the hand is bent or undergoes flection, tensile stresses are created in the elastic material thereby resisting further flection movement. As the fingers are continually bent closer and closer to grip an object and flection is increased, the stress in the elastic material is likewise increased. The overall effect is that the amount of gripping force that can be applied by the wearer is diminished to a marked degree. In the normal case it is desirable to have the thickness of the elastic material adjusted so as to create a gripping power in the right hand substantially equal to or somewhat less than that of the left hand of the individual. The golfer wearing the glove on his right hand will find that with practice his left side will begin to dominate the control and power for the swing and substantially improve the accuracy thereof. Once the golfer becomes accustomed to the motor sensations associated with applying power and control from the left side, he may be able to consciously produce this result without the use of the glove. Accordingly, it is feasible that after a good deal of practice with the glove one may learn to properly handle the swing so as to be able to use the glove only for training refresher purposes.

DRAWING DESCRIPTION

DETAILED DESCRIPTION

Figure 1:
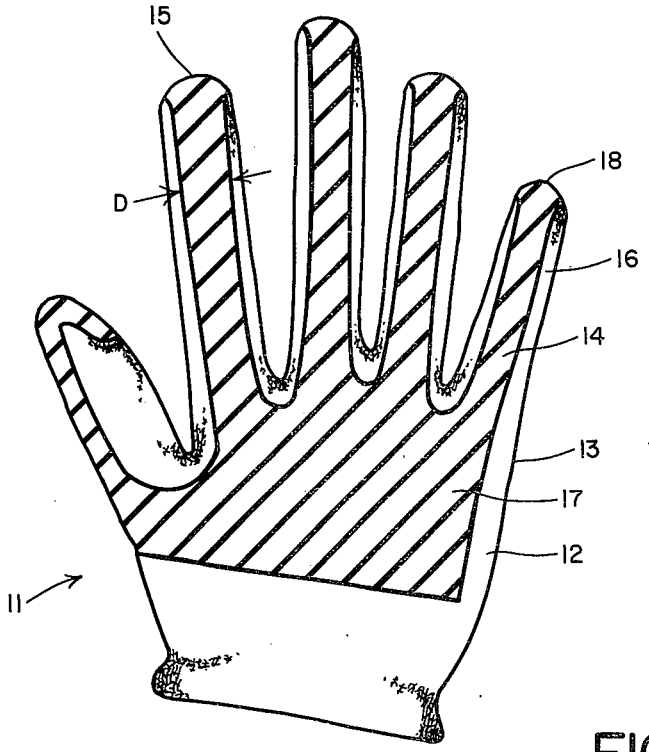
FIG. 1 is a back view of the sports glove of the present invention.

As shown in FIG. 1 glove 11 has located along the back side thereof an elastic material shown as 17 in the hand receptacle portion thereof. The receptacle 16 for the little finger shows, for example, that at the base 13 of said receptacle 16 the finger receptacle is joined to the hand receptacle of the glove. The elastic material is incorporated into the glove in the hand receptacle portion 12 and continues down to the base portion 13 of the finger receptacle 16 and then continues along the back side of finger receptacle 16 all the way to the tip 18 thereof. The elastic material 17 also continues across the back of finger receptacles for the other three fingers, as well as the thumb. As used herein the term "finger" and shall be deemed to include the thumb.

Figure 2:
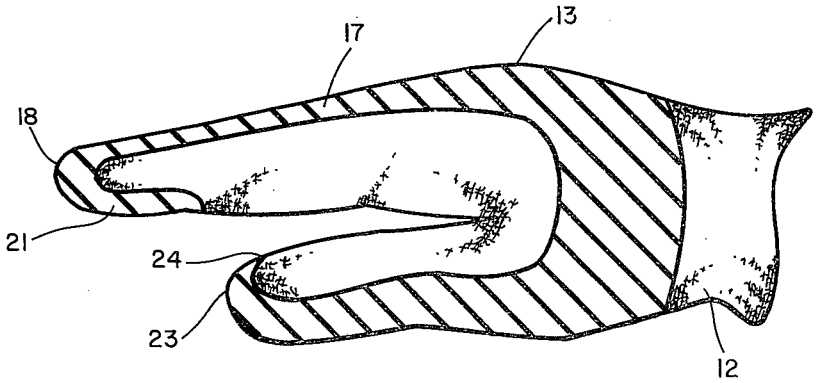
FIG. 2 is a side view of the sports glove of the present invention.

Referring now to FIG. 2 the elastic material 17 is shown to continue around the finger tip 18 and across the pad of the finger 21 for a short distance before terminating. It will be seen, therefore, that the elastic material extends then all the way from the finger tip 18 to the base 13 of the finger receptable and then beyond for a predetermined distance over the back side of the hand receptacle 12 of the glove. When the fingers are bent the elastic material is stretched considerably between the base portion 13 and the finger tip 18 and the energy required by the muscles in the hand and forearm to impart the strain effectively reduce the gripping power of the finger. It is between points 13 and 18 on the glove shown in FIG. 2 that most of the diminution in gripping power is effected. However, it is necessary to have the elastic material to extend in most cases somewhat beyond these two points in order to obtain a parcel on the back of the hand and the finger tip so that full stretching activity takes place between the finger tip 18 and the base of the finger receptacle 13. For a better parcel on the hand portion, it is possible for the elastic material 17 to continue along the back of the hand up to the wrist portion and beyond. However, for most applications the elastic material will perform effectively when placed in the areas indicated in FIG. 2.

Figure 3:
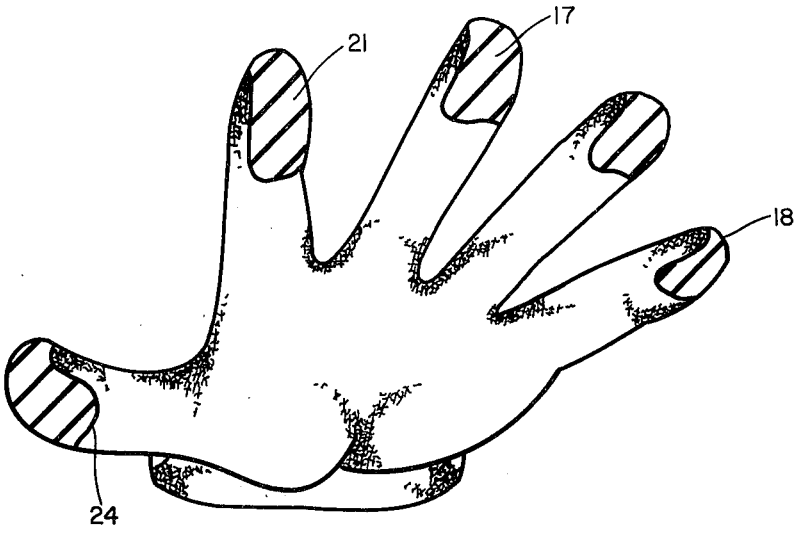
FIG. 3 is a perspective view of the glove from the palm side thereof.

The elastic material continues down the side of the hand in the portion of the thumb so as to provide a continuous hobbling effect on thumb muscle system. Again, the elastic material 17 continues beyond the tip 23 of the thumb to a point 24 on the palm side of the thumb. FIG. 3 shows clearly the continuation of the elastic material around the ends of the fingers and along the palm side of the fingers for a predetermined distance. This distance is usually enough to provide a good parcel on the finger tip by the elastic material so as to maximize the stretching activity along the back side of the finger receptacles.

When the golfer places the glove of the present invention on his dominant hand, namely the right hand in most cases, his wrapping of his fingers about the golf club handle will cause the elastic material 17 to stretch along the back side of the finger receptacles. Accordingly, the golfer will find it increasingly difficult to continue flection as the hand is bent. However, during extension or straightening of the hand, less force will be required due to the tensile forces existing along the back side of the finger receptacles. The non-dominant hand, or the left hand in most cases, is not provided with a glove of the present invention and, accordingly, is able to apply full normal power and gripping force in the process of swinging the club. Accordingly, the hitting side of the body, the non-dominant side, is allowed to dominate and control the golf swing thereby substantially improving the golfer's performance. The choice of elastic material for the purpose of inhibiting flection is not critical provided the material is capable of considerable elasticity without tearing or otherwise breaking down. In actual fabrication of the gloves naturally numerous sizes of gloves will be required because of the different hand sizes of the individuals. In the normal situation a thin layer of elastic material incorporated into the glove in accordance with the above teachings will produce the desired results. As a rule, the thickness of the elastic material is not too substantial and is usually approximately 1/32 of an inch and in some cases less. However, the material can be thicker or thinner than 1/32 inch depending on many factors such as the material type, grip strength of the player, etc. Accordingly, there is no bulk of any significance added to the glove to affect the balance so that once the glove is not used the golfer is not confronted with the problems of balance during the swing. It is to be understood, of course, that in certain circumstances the elastic material must be such that it will require greater or lesser flection force, depending upon the relative strength of the individual. For example, in some cases where the individual has an extremely strong grip, a more resistant elastic material must be used. It is advisable in those circumstances that a grip-testing device be used in order to determine the degree of flection inhibition that must be designed into the glove for that particular individual. In those cases where the individual's grip is quite weak, a correspondingly smaller degree of flection-resisting elastic material would be used.

This tailor making of the glove to fit the particular gripping characteristics of the individual player can be accomplished either by somewhat increasing the thickness of the elastic material, using elastic materials of different properties or by varying the width D as shown in FIG. 1 of the elastic material along the back of the finger receptacle.

Figure 4:
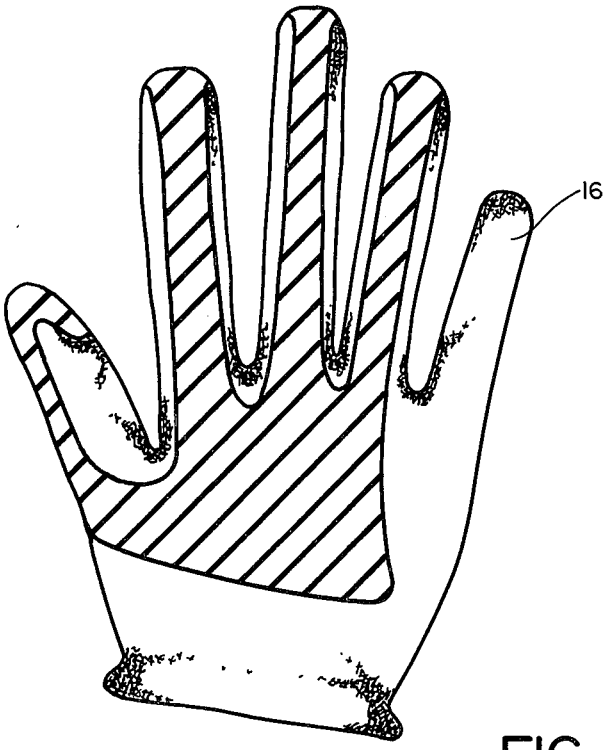
FIG. 4 is a back view of an alternative design of the sports glove of the present invention.

As shown in FIG. 4 there may be instances where, due to particular occupational circumstances or due to diseases, certain of the digits may be so comparatively weak that they do not require any further restraining forces. Accordingly, as shown in FIG. 4 the little finger is not provided with any elastic material. It is possible that one or more digits may likewise have the material removed or substantially reduced in order to compensate for such factors.

In the foregoing description the elastic portion is shown to be incorporated into a normal glove which is made of, for example, a fabric or leather material. However, it is possible to design a glove which is made of strictly elastic material which only covers those portions of the hand shown. Also, the glove material is shown as a continuous material without perforations or other cut-outs or holes. However, it is to be understood that such cut-outs or holes can be incorporated into the glove at various areas without diminishing from the features of the present invention.

Although the sports glove of the present invention has been described for particular use in the game of golf, it is to be understood that it can be used in other sports where a similar problem with the left or non-dominant side being in effect the control or power portion of movement in the game. For example, the glove may find application in such games, such as, croquet, hockey, etc.

Although the preferred embodiment of the present invention has been disclosed above, various modifications thereto will occur to those skilled in the art without departing from the spirit of the invention disclosed herein. Accordingly, the claims attached hereto are to be read as including all modifications and adaptations of the invention falling within the spirit and scope thereof.

I claim:

1. In an improved sports glove having a hand receptacle and finger receptacles, the base of said finger receptacles being connected to said hand receptacle wherein said finger receptacles have a palm side, a fingertip portion and, opposite to said palm side, a back side and wherein the hand receptacle has a palm side and, opposite thereto, a back side, the improvement comprising an elastic material extending a predetermined distance along the back side of said hand receptacle to the base of a predetermined number of said finger receptacles and thence said elastic material extending along the full length of the back side of said predetermined number of finger receptacles and thence over the fingertip thereof curving down and around to the palmside of the finger receptacle and thence extending a predetermined distance down the palmside of the finger receptacle, said elastic material having physical dimensions and properties such as to allow a full range of flection and extension of the fingers contained within said predetermined number of finger receptacles.

2. An improved sports glove as in claim 1 wherein the predetermined number of finger receptacles is five.

3. An improved sports glove as in claim 2 wherein the elastic material extending a predetermined distance along the back side of said hand receptacle extends along a substantial portion of said back side of the hand receptacle.

4. An improved sports glove as in claim 3 wherein the finger receptacles and hand receptacle is comprised of a flexible material and the said elastic material is incorporated into said flexible material.

5. An improved sports glove as in claim 4 wherein the flexible material is a fabric and the elastic material is integrally woven into said fabric.

6. An improved sports glove as in claim 4 wherein the flexible material is a fabric and the elastic material is affixed to the outside surface of said fabric.

7. An improved sports glove as in claim 6 wherein the elastic material is a rubber-based compound.

* * * * *